US009919825B2

(12) United States Patent
Ewert et al.

(10) Patent No.: US 9,919,825 B2
(45) Date of Patent: Mar. 20, 2018

(54) SYSTEM AND METHOD FOR PACKAGING A FOOD PRODUCT

(71) Applicant: ODDS, LLC, Charlotte, NC (US)

(72) Inventors: Brian Ewert, Charlotte, NC (US); John Roberts, Charlotte, NC (US)

(73) Assignee: ODDS, LLC, Charlotte, NC (US)

( * ) Notice: Subject to any disclaimer, the term of this patent is extended or adjusted under 35 U.S.C. 154(b) by 700 days.

(21) Appl. No.: 14/470,743

(22) Filed: Aug. 27, 2014

(65) Prior Publication Data

US 2015/0059290 A1 Mar. 5, 2015

Related U.S. Application Data

(60) Provisional application No. 61/870,892, filed on Aug. 28, 2013.

(51) Int. Cl.

| | |
|---|---|
| ***B65B 59/02*** | (2006.01) |
| ***B65B 11/48*** | (2006.01) |
| ***B65B 57/12*** | (2006.01) |
| ***B65B 25/06*** | (2006.01) |
| ***B65B 51/10*** | (2006.01) |

(Continued)

(52) U.S. Cl.

CPC ..... *B65B 59/02* (2013.01); *B65B 11/48* (2013.01); *B65B 25/065* (2013.01); *B65B 31/00* (2013.01); *B65B 31/048* (2013.01); *B65B 35/16* (2013.01); *B65B 41/14* (2013.01); *B65B 41/16* (2013.01); *B65B 51/10* (2013.01); *B65B 51/14* (2013.01); *B65B 53/063* (2013.01); *B65B 57/12* (2013.01); *B65B 61/025* (2013.01); *B65B 49/00* (2013.01); *B65B 49/08* (2013.01); *B65B 61/06* (2013.01);

(Continued)

(58) Field of Classification Search

CPC ..... B65B 59/02; B65B 11/48; B65B 51/10; B65B 57/12; B65B 49/002; B65B 31/02; B65B 31/04

USPC ..... 53/155, 427, 433

See application file for complete search history.

(56) References Cited

U.S. PATENT DOCUMENTS

| | | | |
|---|---|---|---|
| 3,113,874 | A | 12/1963 | Baush et al. |
| 3,478,486 | A | 11/1969 | Treiber |

(Continued)

FOREIGN PATENT DOCUMENTS

| | | | |
|---|---|---|---|
| DE | 43 10376 | A1 | 10/1993 |
| DE | 10 2012 015 665 | A1 | 2/2013 |

(Continued)

OTHER PUBLICATIONS

European Search Report for European Patent Application No. 14840142.5 dated Apr. 5, 2017.

*Primary Examiner* — Andrew M Tecco
*Assistant Examiner* — Praachi M Pathak
(74) *Attorney, Agent, or Firm* — Tuggle Duggins P.A.; Blake Hurt

(57) ABSTRACT

A system for packaging a food product including a conveying system for supporting and moving the food product. The system includes a detection device for collecting data related to the shape of the food product while the food product is supported by the conveying system. The system also includes a film dispensing device for dispensing one of a plurality of different films. A controller configured to direct the film dispensing device to select one of the plurality of films for dispensing. The system also includes a wrapping device for wrapping the food product in the selected film.

18 Claims, 3 Drawing Sheets

(51) Int. Cl.

| | |
|---|---|
| ***B65B 31/04*** | (2006.01) |
| ***B65B 35/16*** | (2006.01) |
| ***B65B 31/00*** | (2006.01) |
| ***B65B 41/14*** | (2006.01) |
| ***B65B 41/16*** | (2006.01) |
| ***B65B 51/14*** | (2006.01) |
| ***B65B 53/06*** | (2006.01) |
| ***B65B 61/02*** | (2006.01) |
| *B65B 49/00* | (2006.01) |
| *B65B 49/08* | (2006.01) |
| *B65B 61/06* | (2006.01) |
| *B65B 61/28* | (2006.01) |

(52) U.S. Cl.
CPC ..... *B65B 61/28* (2013.01); *B65B 2210/02* (2013.01); *B65B 2210/04* (2013.01)

(56) References Cited

U.S. PATENT DOCUMENTS

| | | | | |
|---|---|---|---|---|
| 3,513,622 | A | 5/1970 | Timmerbeil | |
| 3,691,727 | A * | 9/1972 | Doerscheln | B65B 67/00 226/128 |
| RE27,977 | E | 4/1974 | Monaghan | |
| 3,952,480 | A | 4/1976 | Nordstrom | |
| 4,369,613 | A | 1/1983 | Gess | |
| 4,458,470 | A * | 7/1984 | Fine | B65B 11/54 53/502 |
| 4,825,626 | A * | 5/1989 | Treiber | B65B 11/54 53/131.2 |
| 5,001,884 | A | 3/1991 | Hanagata | |
| 5,655,356 | A * | 8/1997 | Ginestra | B65B 59/00 53/168 |
| 5,667,827 | A * | 9/1997 | Breen | B65B 25/067 426/108 |
| 5,816,990 | A * | 10/1998 | Melville | B65B 59/00 493/10 |
| 5,826,411 | A * | 10/1998 | Butturini | B65B 53/063 53/557 |
| 5,966,908 | A * | 10/1999 | Philipp | B65B 9/067 53/450 |
| 6,349,526 | B1 * | 2/2002 | Newman | B07C 5/10 53/143 |
| 6,470,652 | B1 * | 10/2002 | Piron | B65B 11/48 53/373.4 |
| 6,712,220 | B2 * | 3/2004 | Ruigrok | B07C 5/38 209/592 |
| 6,845,860 | B1 * | 1/2005 | Walker | B65G 47/53 198/433 |
| 6,854,242 | B2 | 2/2005 | Stork et al. | |
| 6,932,751 | B1 | 8/2005 | Ward et al. | |
| 6,938,397 | B2 * | 9/2005 | Miller | B65B 11/18 53/218 |
| 6,955,029 | B2 * | 10/2005 | Palumbo | B65B 43/465 53/168 |
| 7,386,968 | B2 * | 6/2008 | Sperry | B65B 9/02 53/411 |
| 7,530,210 | B2 * | 5/2009 | McGuinness, Jr. | B65B 67/08 53/411 |
| 7,603,831 | B2 * | 10/2009 | Sperry | B65B 9/02 53/450 |
| 7,607,467 | B2 * | 10/2009 | McDonald | B65B 43/123 156/510 |
| 7,886,502 | B2 | 2/2011 | Sperry et al. | |
| 8,033,081 | B2 | 10/2011 | Sperry et al. | |
| 8,393,133 | B2 * | 3/2013 | Parmley | B65B 57/12 53/461 |
| 2003/0145560 | A1 * | 8/2003 | Melville | B65B 59/00 53/459 |
| 2004/0040262 | A1 | 3/2004 | Palumbo | |
| 2013/0042579 | A1 * | 2/2013 | Rother | B65B 25/06 53/435 |
| 2014/0033647 | A1 * | 2/2014 | Izquierdo Ereno | B65B 11/58 53/218 |

FOREIGN PATENT DOCUMENTS

| | | |
|---|---|---|
| GB | 1 419 581 | 12/1975 |
| RU | 233237 C1 | 8/2008 |
| WO | WO 97/24262 | 7/1997 |

* cited by examiner

SYSTEM AND METHOD FOR PACKAGING A FOOD PRODUCT

CROSS REFERENCE TO RELATED APPLICATIONS

The present application claims priority to and the benefit of U.S. Provisional Patent Application No. 61/870,892, filed Aug. 28, 2013. The foregoing provisional application is incorporated by reference herein in its entirety.

BACKGROUND

The present application relates generally to the field of food product packaging. In one embodiment, the present application relates to a packaging system for wrapping various sized and shaped cuts of whole muscle meat in a plastic film.

Carcasses are commonly cut at a meat packing facility into cuts of various sizes and shapes and shipped to the retail location as what is commonly known as case-ready (e.g., store-ready, shelf-ready, etc.) meat. The cuts of meat may be wrapped in a polymer film (e.g. polypropylene film) that is fed to a packaging system. The film may then be folded around the cut of meat, sealed around the cut of meat, and shrunken. The time to shrink the film varies with the size of the cut of meat being wrapped.

Typically, a meat packing facility may have a packaging system that is configured to use a single size (e.g., width) of film. The film is generally sized to be capable or wrapping a larger cut of meat. If the cut of meat to be wrapped is smaller, a large amount of the film is wasted and a longer amount of time is required to shrink the film. Both the wasted material and the additional heat and time needed to shrink the film can add cost to the final product.

In addition, in existing food packaging systems, several machines are required to package a food product. Each machine provides a unique function such as, for example, wrapping, sealing, etc. Operating several machines and moving product between machines typically requires a large number of personnel and a large amount of floor space within a packaging facility. As a result, there is a need for a more compact system that requires fewer personnel to operate.

BRIEF DESCRIPTION OF THE DRAWINGS

Features, aspects, and advantages of the present invention will become apparent from the following description and the accompanying exemplary embodiments shown in the drawings, which are briefly described below.

DETAILED DESCRIPTION

It is to be understood that the following detailed description are exemplary and explanatory only, and are not restrictive of the invention.

The packaging system described herein provides a novel system for wrapping a food product provided on a first conveyer in a film that is sized to match the size and shape of the food product. The packaging system detects the shape and/or size of the food product, moves the food product from the first conveyer to a second conveyer, and wraps the food product in a film. The film is chosen from a variety of films of different sizes to match the detected size and shape of the food product. The film is then sealed around the food product to form a closed package, the air is evacuated from the interior of the package, and the package is exposed to heat to shrink the film. The packaged food product is then moved from the second conveyer to a third conveyer.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

Figure 1:
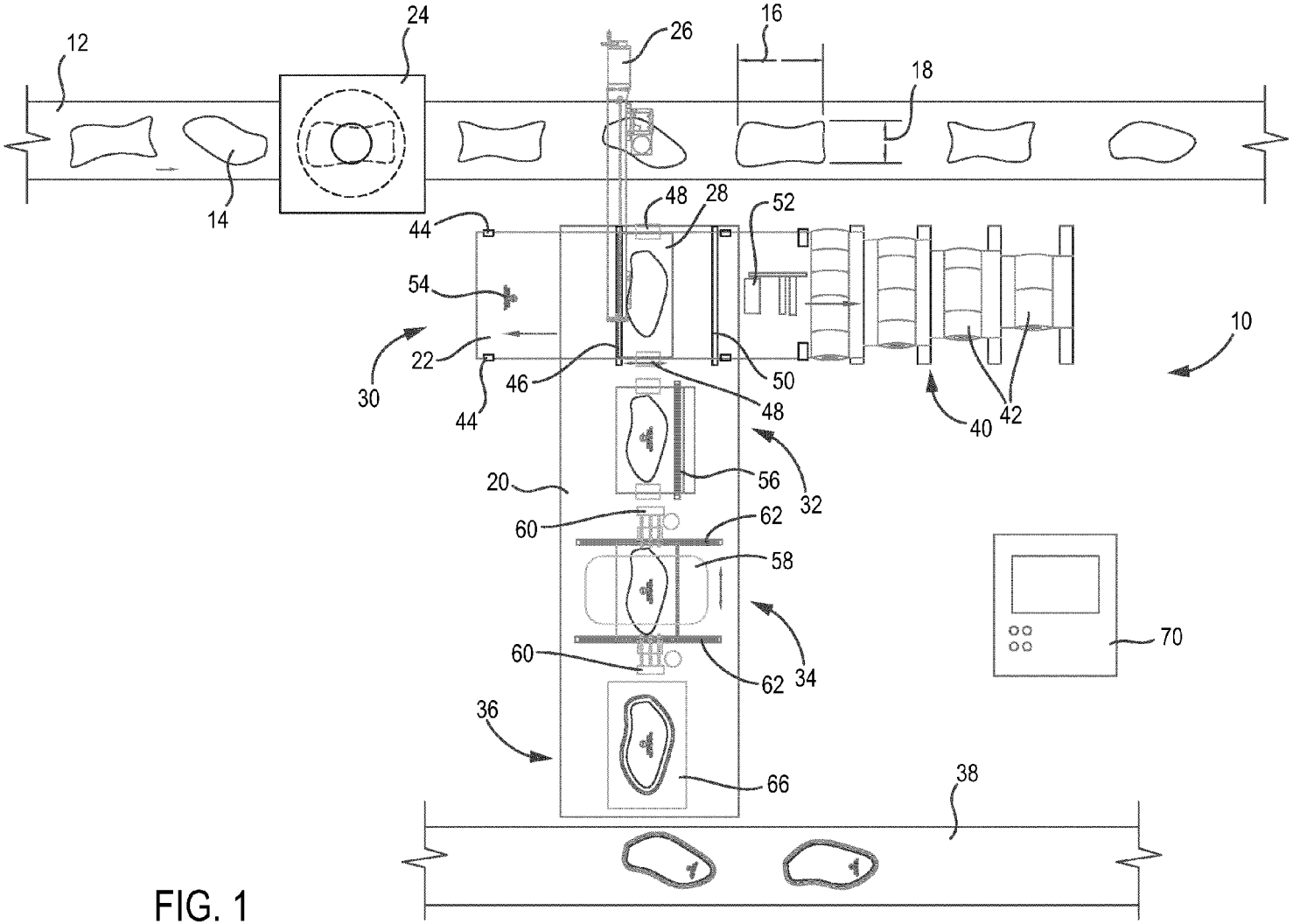
FIG. 1 is a schematic view of a food product packaging system, according to an exemplary embodiment.

Referring to FIG. 1, a packaging system 10 is shown according to an exemplary embodiment. The packaging system 10 includes a conveying system that includes a first conveyer 12 carrying a food product 14. The food product 14 may be irregularly shaped and have a first dimension 16 (e.g., length, maximum dimension, etc.) and a second dimension 18 (e.g., width, minimum dimension, etc.). Each of the food products 14 may be shaped and sized differently with the first dimension 16 and the second dimension 18 varying between the food products 14. According to an exemplary embodiment, the food product 14 is a cut of whole muscle meat. In another embodiment, the food product may be another meat product (e.g., a portion of ground meat, etc.). In still another embodiment, the food product may be formed completely or partially of vegetable material, soy, bread, or another food product that may benefit from being packaged in a film.

The conveying system includes a transfer device (e.g., robot arm described below) for transferring the food products 14 from the first conveyer 12 to a second conveyer 20 (e.g., an indexing plate conveyer) where a film 22 is wrapped around the food product 14. The film 22 is sealed and heat shrunk around the food product. The packaging system 10 includes film 22 provided in various widths. The packaging system 10 is configured to select film 22 with a minimal width capable of being sealed around each individual food product 14. The amount of wasted film and the time and energy needed to shrink the film 22 is thereby minimized, reducing the cost and time required to wrap the food product 14.

The dimensions (e.g., the first dimension 16 and the second dimension 18) of the food product 14 on the first conveyer 12 is determined by the packaging system 10. According to an exemplary embodiment, the packaging system 10 includes a detection device. The detection device collects data related to the shape of the food product. For example, the detection device may include a weight or pressure sensor that senses the position of the food product. The detection device may include a photo eye or photoelectric detector including a transmitter and receiver to detect the presence of absence of the food product. In another embodiment, the detection device may be, for example, a vision camera 24 positioned above the first conveyer 12 upstream of the second conveyer 20. The vision camera 24 captures an image of the food product 14. The image is transferred to a control system 70 that analyzes the image to determine the maximum dimension, first dimension 16, and the minimum dimension, second dimension 18. The image and dimension data is stored by the control system 70. In other embodiments, the control system 70 may receive alternative data related to the shape of the product such as data from a photo electric sensor or weight/pressure sensor. The control system 70 may determine more than the two dimensions. For example, the control system may analyze the collected data to determine three dimensions such as, for example, height, width and length of the food product.

The food product 14 continues along the first conveyer 12 until it is grabbed from first conveyer 12 by a robot arm 26. The robot arm 26 transfers the food product 14 to the second conveyer 20 and places the food product 14 on a transport plate 28 of the second conveyer 20. The robot arm 26 may rotate the food product 14 such that it is placed on the transport plate 28 lengthwise with the first dimension 16 of the food product oriented along the direction of travel of the second conveyer 20. This orientation of the food product minimizes the length of the film needed to wrap the food product 14.

The second conveyer 20 of the packaging system 10 carries the food product to a first station 30 (e.g., wrapping station), a second station 32 (e.g., top sealing station), a third station 34 (e.g., side sealing and vacuum station), and a fourth station 36 (e.g., heat shrink station) before depositing the wrapped food product 14 onto a third conveyer 38. According to a preferred embodiment, the first, second, third and fourth stations are contained within a single machine or assembly unit. Thus, the disclosed arrangement offers significant cost and efficiency improvements over conventional systems that employ each station in a separate and discrete unit. The system controller may also be integrated into the single integrated machine or assembly unit.

At the first station 30, the food product 14 is wrapped in the film 22. According to an exemplary embodiment, the packaging system 10 includes a film dispenser 40 with a multitude of rolls 42 of film 22, the rolls 42 having various widths. The control system 70 determines an optimal width of film 22 for wrapping the food product 14 and directs the dispensing of film 22 from the roll 42 having the smallest width that is greater than the first dimension 16 of the food product 14 and large enough to form a proper seal on either side of the food product 14. According to an exemplary embodiment, the film dispenser 40 includes four rolls 42. The rolls may have varying widths depending on the application.

Film 22 from the appropriate roll 42 is routed to the food product 14 on the second conveyer 20 over rollers and guides. The end of the film 22 is fed out with film guides 44 (e.g., clamps) that grasp either side of the film 22. After the correct length of film 22 (e.g., based on the second dimension 18) is fed out, the food product 14 is placed on the film 22 by the robot arm 26. The film 22 is folded over the food product 14 using a fold bar 46. A gap is maintained between the layers along either side of the film 22 by bag opening keepers 48. Once the food product 14 is wrapped, it is cut with a cutter or cutting device 50. The cutter 50 may be any device capable of severing the film 22, such as a laser cutter (e.g., a $CO_2$ laser), a heated wire, a knife, a cutting wheel, shears, or any other suitable device known in the art. The first station 30 may further include a printer 52 capable of printing an indicia 54 (e.g., logo, label, cooking and handling instructions, nutritional information, etc.) on the film 22 as the film 22 is being fed from the roll 42. According to an exemplary embodiment, the film 22 is fed from the appropriate roll 42 at a rate of up to 12 inches per second, which allows the printer 52 to print the indicia 54 on the film 22 as it is fed from the roll 42. According to other exemplary embodiments, the film 22 may be fed from the roll 42 at a higher rate (e.g., if the packaging system 10 does not include a printer 52).

Once the food product 14 is wrapped in the film 22, it is advanced from the first station 30 to the second station 32. At the second station 32, the top edge of the film 22 is sealed. According to an exemplary embodiment, film is sealed with a top seal bar 56. The top seal bar 56 is lowered onto the film 22 at a small distance from the food product 14 and heated to meld the two layers of film 22 together. In one embodiment, the top seal bar 56 may be positioned at a distance from the folded edge of the film 22 that is greater than the largest expected second dimension 18 of the food product 14. In another embodiment, the position of the top seal bar 56 may be variable and may be determined by the control system 70 based on the second dimension 18 of each individual food product 14, as detected by the vision camera 24.

Once the top seal has been formed in the film 22, the top seal bar 56 is raised and the food product 14 is advanced from the second station 32 to the third station 34. At the third station 34, the film 22 is compressed by a compression member 58 to push out air trapped between the two layers, a vacuum is drawn by vacuum pumps 60 positioned on either side of the film 22, and the sides of the film 22 are sealed with a left and a right side seal bars 62. The compression member 58 is lowered onto the top layer of film 22. The compression member 58 is a resilient or deformable member that is able to conform to the shape of the food product 14 to press the top layer of the film 22 against the food product 14 and the lower layer of the film 22 to evacuate a majority of the air between the layers of the film 22. Additional air is removed by the vacuum pumps 60. According to an exemplary embodiment, the vacuum pumps 60 are coupled to the bag opening keepers 48. The compression member 58 is raised and the left and right seal bars 62 are lowered onto the film 22 at a small distance from the food product 14 between the food product 14 and the bag opening keepers 48. The left and right seal bars 62 are heated to meld the two layers of film 22 together. In one embodiment, the left and the right seal bars 62 may be positioned at a distance from the edges of the film 22 that is greater than the largest expected first dimension 16 of the food product 14. In another embodiment, the position of the left and right seal bars 62 may be variable and may be determined by the control system 70 based on the first dimension 16 of each individual food product 14, as detected by the vision camera 24.

Once the left and right side seals have been formed in the film 22, the left and right seal bars 62 are raised and the food product 14 is advanced from the third station 34 to the fourth station 36. At the fourth station 36, the film 22 is shrunk around the food product 14 in a heat shrink chamber 66. The heat shrink chamber 66 exposes the wrapped food product 14 to an elevated temperature that shrinks the film 22. The temperature of the heat shrink chamber 66 and the duration of time the wrapped food product 14 remains in the heat shrink chamber 66 may be controlled by the control system 70 and varied based on the size of the food product 14 and the width of the film 22 used to wrap the food product 14.

Once the film 22 has been shrunk a desired amount, the food product 14 is removed from the heat shrink chamber 66 by the second conveyer 20 and deposited onto the third conveyer 38. The optional third conveyer 38 moves the food product 14 away from the packaging system 10 and may transport the food product 14 to be further packaged or processed.

While only a single packaging system 10 is shown in FIG. 1, it should be understood that, in other embodiments, multiple packaging systems may be provided operating in parallel. The multiple packaging systems may be equipped with the same widths of film or may be equipped with different widths of film. The control system may determine to which packaging system the food product 14 is transferred based on the detected size of the food product 14.

Figure 2:
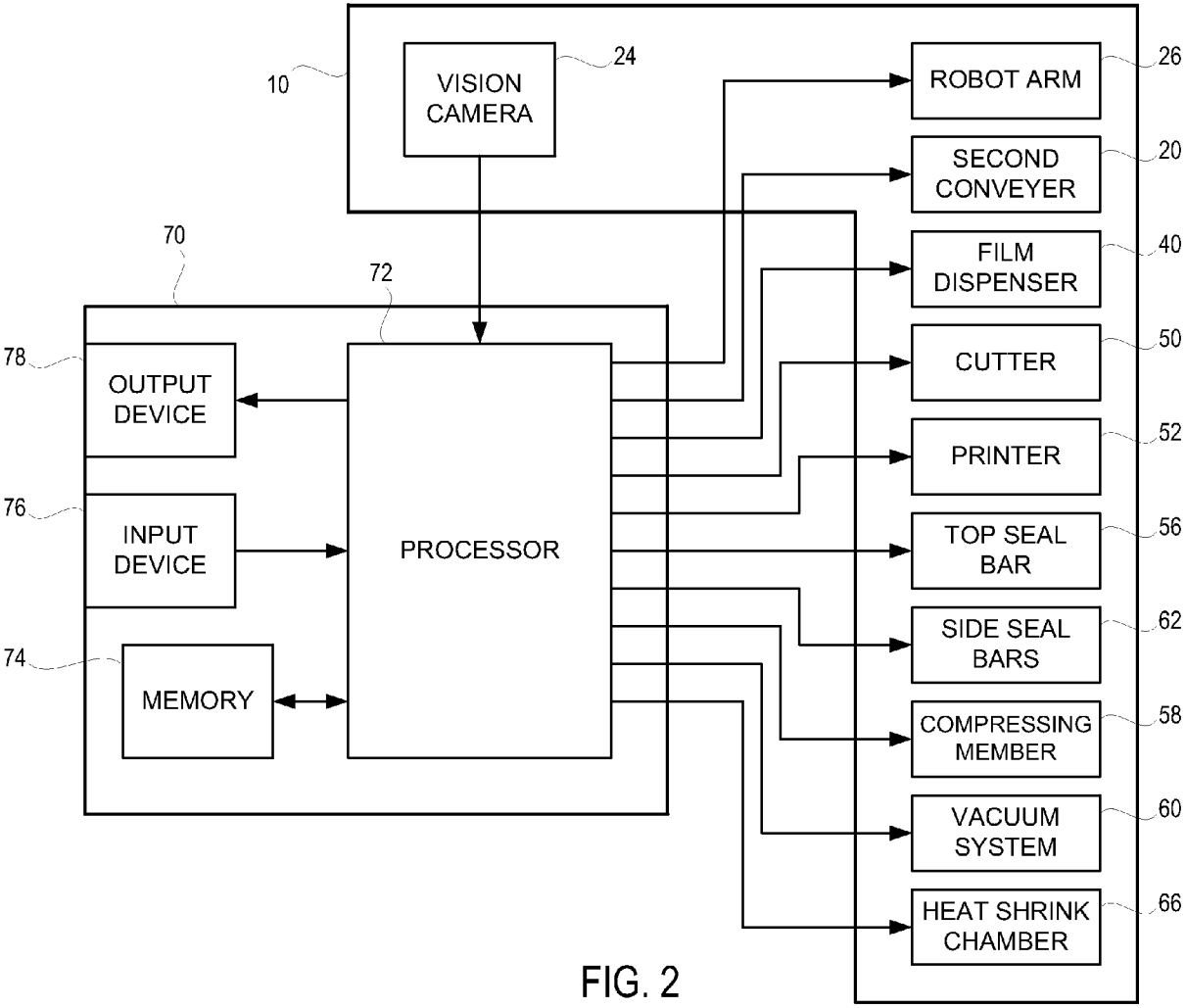
FIG. 2 is a schematic block diagram of a control system for the packaging system of FIG. 1, according to an exemplary embodiment.

Referring to FIG. 2, a schematic block diagram of the control system 70 is shown according to an exemplary embodiment. The control system 70 is configured to manage the operation of the packaging system 10 to select a film 22 of a minimum width capable of wrapping a particular food product 14. In an exemplary embodiment, the control system 70 includes a processor 72, a memory device 74, a user input device 76, and an output device 78. The control system 70 may control the packaging of the food product 14 based on the detected size and shape of the food product 14. The control system 70 receives input from the vision camera 24. The control system 70 sends outputs control signals to devices such as the second conveyer 20, the robot arm 26, the film dispenser 40, the cutter 50, the top seal bar 56, the compressing member 58, the vacuum pumps 60, the side seal bars 62, and the heat shrink chamber 66. According to an exemplary embodiment, components of the control system 70 may be housed in an industrial cabinet to protect the components from the elements.

The processor 72 can be implemented as a general purpose processor, an application specific integrated circuit (ASIC), one or more field programmable gate arrays (FPGAs), a group of processing components, or other suitable electronic processing components. In another exemplary embodiment, the control system 70 may include a controller lacking a processor or memory. For example, the control system may be a linear circuit.

The memory device 74 (e.g., memory, memory unit, storage device, etc.) is one or more devices (e.g., RAM, ROM, Flash memory, hard disk storage, etc.) for storing data and/or computer code for completing or facilitating the various processes, layers and modules described in the present application. The memory device 74 may be or include volatile memory or non-volatile memory. The memory device 74 may include database components, object code components, script components, or any other type of information structure for supporting the various activities and information structures described in the present application. According to an exemplary embodiment, the memory device 74 is communicably connected to the processor via the processing circuit and includes computer code for executing (e.g., by processing circuit and/or processor) one or more processes described herein.

The input device 76 is one or more devices that allow a user to input commands and control variables for the packaging system 10. The input device 76 may be, for example, a touch screen monitor, a keyboard or keypad, push buttons, dials, switches, or any combination of devices. The output device 78 is one or more devices that allow a user to monitor the properties of the perforation system 20 and may be integrated with the input device 76. The output device 78 may be, for example, a monitor, a touch screen monitor, a text display, a numeric display, or a combination of devices.

Figure 3:
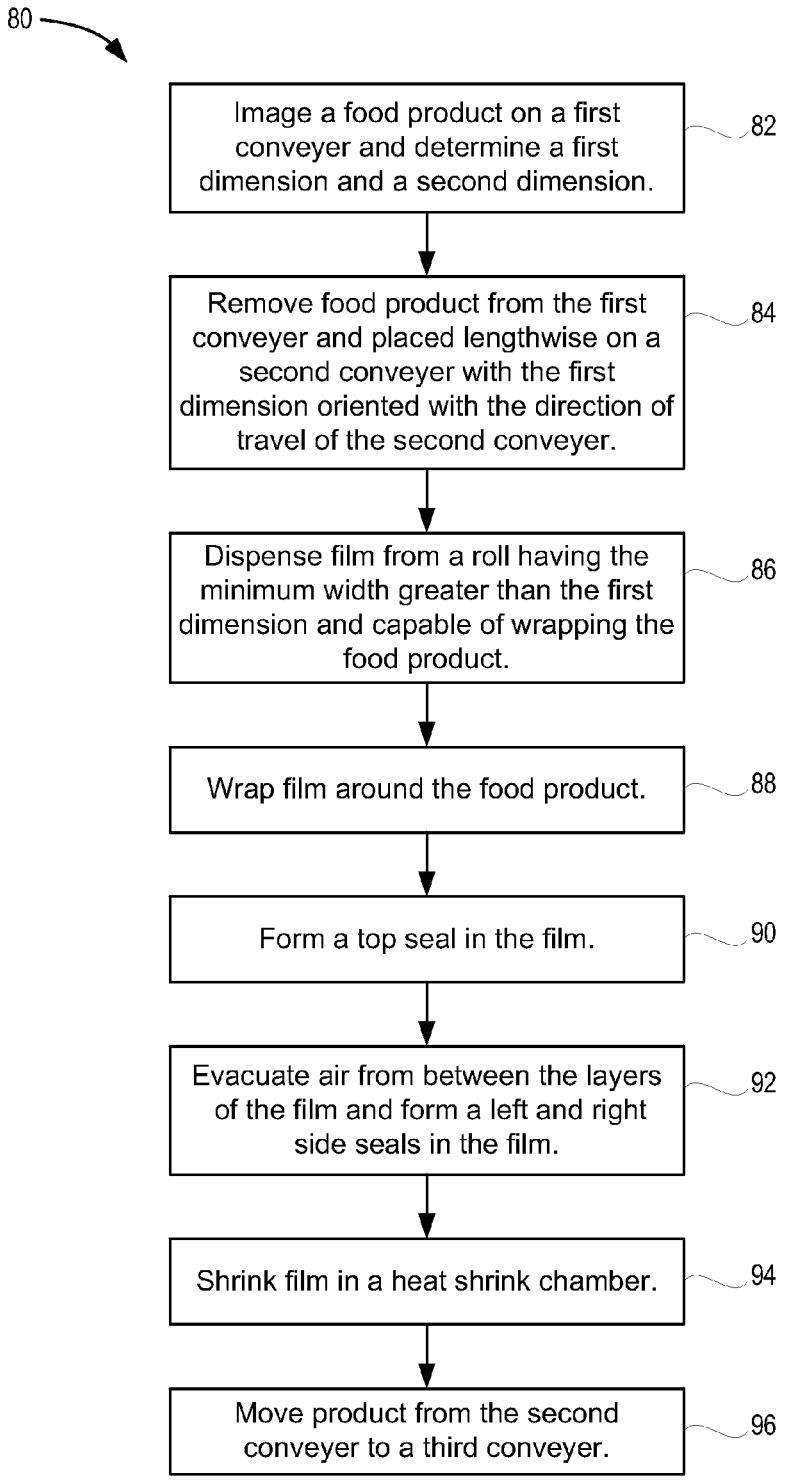
FIG. 3 is a flow chart of a method for wrapping a food product with a film, according to an exemplary embodiment.

Referring now to FIG. 3, a flowchart of a method 80 for operating the packaging system 10 is shown according to an exemplary embodiment. Food product on a first conveyer is imaged using a vision camera to determine a first, maximum dimension and a second, minimum dimension of the food product (step 82). The food product is then removed from the first conveyer and placed lengthwise on a second conveyer, with the first dimension oriented with the direction of travel of the second conveyer (step 84). At a first station, film is dispensed from a roll having the minimum width greater than the first dimension and capable of wrapping the food product (step 86). The film is wrapped around the food product (step 88). The food product is moved along the second conveyer to a second station and a top seal is formed in the film (step 90). The food product is then moved along the second conveyer to a third station, the air is evacuated from between the layers of film and a left side seal and right side seal are formed in the film (step 92). The food product is then moved along the second conveyer to a fourth station and the film is shrunk in a heat shrink chamber (step 94). Finally, the food product is moved from the second conveyer to a third conveyer (step 96).

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

It is important to note that the construction and arrangement of the system and method for wrapping meat as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A system for packaging a food product comprising:

a conveying system for supporting and moving the food product, the conveying system further comprising a first conveyer defining a first direction of travel and a second conveyer defining a second direction of travel, the first direction of travel different than the second direction of travel;

a transfer device configured to transfer the food product from the first conveyor to the second conveyer;

a detection device for collecting data related to the shape of the food product while the food product is supported by the conveying system;

a film dispensing device for dispensing one of a plurality of different films;

a controller configured to direct the film dispensing device to select one of the plurality of films for dispensing; and a wrapping device for wrapping the food product in the selected film;

wherein the controller is configured to determine two dimensions of the food product based on the collected data received from the detection device and to determine which of the two dimensions is the greater dimension and which is the lesser dimension; and wherein the transfer device orients the food product on the second conveyer with the greater dimension parallel to the second direction of travel.

2. The system of claim 1, wherein the controller is configured to direct the film dispensing device based on the determined two dimensions of the food product.

3. The system of claim 2, wherein each of the plurality of different films is stored on a different roll.

4. The system of claim 3, wherein the film dispensing device is configured so that the selected film is dispensed a predetermined distance based on one of the determined two dimensions of the food product.

5. The system of claim 2, wherein the transfer device is defined as a robotic arm configured to transfer the food product from the first conveyer to the second conveyer, wherein the greater and lesser dimensions are defined as lateral and longitudinal dimensions.

6. The system of claim 1, wherein each of the plurality of films is a different width than each of the other plurality of films.

7. The system of claim 1, wherein the system is configured to seal the film wrapped around the food product.

8. The system of claim 1, further comprising a vacuum pump for removing air from within the film wrapped food product.

9. The system of claim 8, further comprising a heating chamber where the wrapped food product is heated to thereby shrink the film around the food product.

10. The system of claim 8, further comprising a resilient compression member that contacts the wrapped food product to thereby force air out from within the film wrapping the food product.

11. A system for packaging a food product comprising:

a conveying system for supporting and moving the food product, the conveying system further comprising a first conveyer defining a first direction of travel and a second conveyer defining a second direction of travel, the first direction of travel perpendicular to the second direction of travel;

a transfer device configured to transfer the food product from the first conveyor to the second conveyer a detection device for collecting data related to the shape of the food product while the food product is supported by the first conveyer;

a film dispensing device for dispensing one of a plurality of different films;

a controller configured to direct the film dispensing device to select one of the plurality of films for dispensing based on data received from the detection device;

a wrapping device for wrapping the food product in the selected film;

an air extraction device to remove air from within a space between the film and the food product;

a film shrinking device to contract the film tightly around the food product; wherein the second conveyer carries the food product continuously from the wrapping device to the air extraction device and to the film shrinking device;

wherein the wrapping, air extraction and film shrinking devices are integrated together into a single packaging machine; and wherein the controller is configured to determine at least two dimensions of the food product based on the collected data received from the detection device and to determine which of the at least two dimensions is the greater dimension and which is the lesser dimension, the greater and lesser dimensions each capable of being aligned parallel to the second direction of travel, and wherein the transfer device orients the food product on the second conveyer with the greater dimension parallel to the second direction of travel.

12. The system of claim 11, wherein the at least two dimensions are defined at least by a lateral dimension and a longitudinal dimension.

13. The system of claim 11, wherein the controller is configured to determine a third dimension of the food product based on collected data received from the detection device.

14. The system of claim 11, wherein the single packaging machine further includes a cutting device for cutting the film after the food product is wrapped.

15. The system of claim 11, wherein the single packaging machine further includes a device for heat sealing two opposing surfaces of the film together.

16. A method for wrapping a food product comprising the steps of:

providing the system for packaging a food product of claim 1;

detecting the presence of the food product while the food product is supported by the first conveyer device, collecting data related to a shape of the food product and determining first and second dimensions of the food product based on the collected data;

dispensing one of a plurality of different films based on the first dimension of the food product;

wrapping the food product in the selected film;

extracting air from within a space between the film and the food product;

shrinking the film in order to contract the film tightly around the food product, wherein the wrapping, extracting and shrinking steps are performed while the food product is in a single packaging machine, and wherein the controller is configured to determine the first and second dimensions of the food product based on the collected data received from the detection device and to determine which of the at least two dimensions is the greater dimension and which is the lesser dimension, and wherein the transfer device orients the food product on the second conveyer with the greater dimension parallel to the second direction of travel.

17. The method of claim 16, further comprising the step of determining a third dimension of the food product based on the detected shape.

18. The method of claim 16, wherein the dispensing step includes dispensing the selected film a predetermined distance based on the second dimension.

* * * * *